US011473240B2

(12) United States Patent
Goldschmidt

(10) Patent No.: US 11,473,240 B2
(45) Date of Patent: Oct. 18, 2022

(54) USE OF A ROPE OF FIBROUS PLANT MATERIAL AS COMBUSTIBLE MATERIAL

(71) Applicant: Rolf Goldschmidt, Langenorla (DE)

(72) Inventor: Rolf Goldschmidt, Langenorla (DE)

(73) Assignee: Rolf Goldschmidt, Langenorla (DE)

( * ) Notice: Subject to any disclaimer, the term of this patent is extended or adjusted under 35 U.S.C. 154(b) by 0 days.

(21) Appl. No.: 16/643,001

(22) PCT Filed: May 29, 2018

(86) PCT No.: PCT/EP2018/064051
§ 371 (c)(1),
(2) Date: Feb. 28, 2020

(87) PCT Pub. No.: WO2019/042601
PCT Pub. Date: Mar. 7, 2019

(65) Prior Publication Data

US 2020/0208345 A1 Jul. 2, 2020

(30) Foreign Application Priority Data

Aug. 30, 2017 (DE) ..... 102017119897.0

(51) Int. Cl.
*F23B 40/00* (2006.01)
*D07B 5/02* (2006.01)
(Continued)

(52) U.S. Cl.
CPC ..... *D07B 5/02* (2013.01); *F23B 40/00* (2013.01); *F24B 1/028* (2013.01); *F24B 13/04* (2013.01);
(Continued)

(58) Field of Classification Search
CPC ..... F24B 1/028; F24B 13/04; F23B 13/04; F23B 40/00; F23D 3/08; F23D 3/02;
(Continued)

(56) References Cited

U.S. PATENT DOCUMENTS 31,045 A * 1/1861 Weeden ..... F21V 37/00 431/298
31,049 A * 1/1861 Wortendyke ..... F21V 37/00 431/298
(Continued)

FOREIGN PATENT DOCUMENTS

CN 101718047 A 6/2010
DE 2523968 A1 12/1976
(Continued)

OTHER PUBLICATIONS

"DE_2523968_A1_M—Machine Translation.pdf", machine translation, EPO.org, Apr. 23, 2021. (Year: 2021).*
(Continued)

*Primary Examiner* — Steven B McAllister
*Assistant Examiner* — Daniel E. Namay
(74) *Attorney, Agent, or Firm* — Williams Mullen; David M. Saravitz

(57) ABSTRACT

A rope is used as a combustible material in a heating system, the rope comprising or consisting of fibrous plant material. Also, a method of operating a heating system comprises feeding a combustible material to a combustion chamber of the heating system, the combustible material being a rope of fibrous plant material.

18 Claims, 4 Drawing Sheets

(51) Int. Cl.

| | |
|---|---|
| ***F24B 1/02*** | (2006.01) |
| ***F24B 13/04*** | (2006.01) |
| ***F24D 5/06*** | (2006.01) |
| ***F24D 15/00*** | (2022.01) |

(52) U.S. Cl.
CPC ..... *F24D 5/06* (2013.01); *F24D 15/00* (2013.01); *D07B 2201/104* (2013.01); *D07B 2205/103* (2013.01); *D07B 2501/20* (2013.01); *F24D 2200/07* (2013.01)

(58) Field of Classification Search
CPC .... F23D 3/24; F23D 2900/03082; F24D 5/06; F24D 15/00; F24D 2200/07; D07B 5/02; D07B 2201/104; D07B 2205/103; D07B 2501/20
USPC ..... 431/298, 282
IPC ..... D07B 5/02; F23B 40/00,1/02, 13/04; F24D 15/06, 15/00
See application file for complete search history.

(56) References Cited

U.S. PATENT DOCUMENTS

| | | | | |
|---|---|---|---|---|
| 419,040 | A * | 1/1890 | Goldstein et al. | F23D 3/00 431/282 |
| 6,286,248 | B1 * | 9/2001 | Bryant | A01M 1/2066 43/125 |
| 2016/0158299 | A1 * | 6/2016 | Bohus | A61K 31/05 424/725 |

FOREIGN PATENT DOCUMENTS

| | | |
|---|---|---|
| DE | 3017384 A1 | 11/1981 |
| DE | 102008061266 | 5/2010 |
| DE | 202012104151 U1 | 12/2012 |
| EP | 1375632 | 1/2004 |

OTHER PUBLICATIONS

"DE_202012104151_U1_M—Machine Translation.pdf", machine translation, EPO.org, Apr. 23, 2021. (Year: 2021).*
"_Definition—Bundle—Dictionary 2021-12-04.pdf", dictionary.com, Dec. 4, 2021. (Year: 2021).*
"_Definition—Rope—Dictionary 2021-12-04.pdf", dictionary.com, Dec. 4, 2021. (Year: 2021).*
International Search Report PCT/EP2018/064051, dated Sep. 19, 2018.
Written Opinion of the International Searching Authority, in PCT/EP2018/064051, dated Sep. 19, 2018.

* cited by examiner

USE OF A ROPE OF FIBROUS PLANT MATERIAL AS COMBUSTIBLE MATERIAL

CROSS-REFERENCE TO RELATED APPLICATIONS

This application is the U.S. National Stage of International Application PCT/EP2018/064051, filed May 29, 2018, which designates the U.S and was published by the International Bureau in English on Mar. 7, 2019, and which claims the benefit of German Patent Application No. 10 2017 119 897.0, filed Aug. 30, 2017; all of which are hereby incorporated herein in their entirety by reference.

FIELD OF THE INVENTION

The invention relates to the use of a rope as a combustible material for or in a heating system, wherein the rope comprises or consists of fibrous plant material, preferably straw. The invention also relates to a method of operating a heating system, comprising feeding a rope of fibrous plant material to a combustion chamber of the heating system.

BACKGROUND OF THE INVENTION

Renewable resources are of growing importance as energy sources. Agriculture and forestry offer sustainable or renewable combustible materials. Blades, scraps, coal briquets, and pellets of comminuted wood are increasingly used in modern heaters and furnaces.

Although wood pellets are commonly used in heating systems, there are many drawbacks of such use. In many countries, there are not sufficient amounts of wood available for pellet production to meet the increasing demands, whereby wood pellets are frequently transported over large distances, sometimes even overseas, to reach a heating system operating with wood pellets. Further, production of the pellets from wood also consumes energy. As a result, large amounts of energy, frequently as fossil fuels, are needed for production and transport of wood pellets, whereby, overall, such wood pellets can hardly be considered a renewable energy source. Further, although wood is considered a $CO_2$-neutral raw material (at least if obtained from sustainable forestry), trees grow slowly, whereby it takes a long time until the $CO_2$ emitted by combusted wood pellets is re-assimilated by carbon fixation by growing trees.

Straw pellets are only occasionally used as combustible material. Straw pellets are made by comminuting or milling straw, followed by wetting with water and pressing. During the comminution, the lignin of the straw is broken, whereby the adsorptive capacity for water greatly increases. Generally, the adsorptive capacity for water of straw pellets is about twelve times higher than that of straw. Therefore, straw pellets must be stored under dry conditions for later use as a combustible material, which is difficult and expensive. As a consequence, straw pellets are mainly used as litter in stables for cattle. Further, straw pellets have a low inflammability, whereby their usefulness as a combustible material is limited.

Similarly to straw pellets, compressed straw from compact bales such as the round bales generally produced in agriculture from straw on farm fields is also not suitable for combustion in heating systems, since the inflammability is low. On the contrary, loosely packed straw has high inflammability, but little caloric value per volume and very short burning time. For example, DE 30 05 039 A1 describes a method of combusting loosely packed solid material, especially straw, which must be portioned before combustion. Due to these difficulties, straw has not been widely used as a combustible material for controlled burning in heating systems. On the other hand, its $CO_2$ neutrality and good availability render straw and similar fibrous plant material attractive renewable energy sources.

It is therefore an object of the invention to provide a combustible material for a heating system, which is environmentally friendly and has good combustibility. Further, combustion should be easily controllable.

SUMMARY OF THE INVENTION

For accomplishing this object, the invention provides:

(1) A use of a rope as a combustible material in a heating system, said rope comprising or consisting of fibrous plant material.

(2) The use according to item 1, wherein said rope comprises at least two strands made of the fibrous plant material, said strands being twisted to form said rope.

(3) The use according to item 1 or 2, wherein said rope is a two-stranded or three-stranded rope.

(4) The use according to item 2 or 3, wherein the strands are twisted to form said rope such that the length of the rope has more than 67% of the length of the strands before twisting of the strands to form the rope.

(5) The use according to item 2 or 3, wherein the strands are twisted to form said rope such that the length of the rope has less than 67% of the length of the strands before twisting of the strand to form the rope.

(6) The use according to any one of items 2 to 5, wherein the strands are made from multiple elongated elements of the fibrous plant material by stranding or spinning.

(7) The use according to any one of items 2 to 6, wherein each strand has a diameter of from 1 to 20 cm, preferably from 1 to 10 cm, more preferably from 2 to 6 cm.

(8) The use according to item 1, wherein said rope is a one-stranded rope made from multiple elongated elements of the fibrous plant material by stranding or spinning.

(9) The use according to item 1 or 8, wherein said rope or a strand of said rope is made by orienting at least two elongated elements of the fibrous plant material essentially in parallel so as to form combination of at least partially overlapping elongated elements essentially oriented in parallel, securing the elongated strands together at a desired position of the combination, twisting the elongated elements of the strand starting from the secured position while continuously feeding further elongated elements into the twisting combination to form a strand or one-stranded rope.

(10) The use according to any one of items 1 to 9, wherein the rope has a diameter of from 1 to 50 cm, preferably of from 3 to 15 cm.

(11) The use according to any one of items 1 to 10, wherein the rope has a length of at least 1 m, preferably at least 3 m, more preferably at least 10 m.

(12) The use according to any one of items 1 to 11, wherein the fibrous plant material comprises or consists of blades, such as straw blades.

(13) The use according to any one of items 1 to 11, wherein the fibrous plant material comprises or consists of blades, such as straw blades, of monocotyledonous plants.

(14) The use according to any one of items 1 to 13, wherein the fibrous plant material comprises or consists of blades, such as straw blades, of plants of family Poaceae, preferably of Pooideae.

(15) The use according to any one of items 1 to 14, wherein the fibrous plant material is straw and/or the rope is a straw rope.

(16) The use according to any one of items 1 to 15, wherein the rope can be wound or coiled for storage.

(17) The use according to any one of items 1 to 16, wherein the heating system is a heater, furnace and/or central heating system of a building or facility.

(18) A method of operating a heating system, comprising feeding a combustible material to a combustion chamber of the heating system, said combustible material being a rope of fibrous plant material.

(19) The method of item 18, wherein the rope is fed mechanically into a combustion chamber of the heating system by a feeding device.

(20) The method of item 18 or 19, wherein the rope is wound, e.g. to a roll, and the rope is fed into the combustion chamber of the heating system while unwinding the rope.

(21) The method of any one of items 18 to 20, wherein the feeding rate of the rope is controlled so as to provide a desired heat generation upon burning the rope in the combustion chamber.

(22) The method of any one of items 18 to 21, as further defined in any one of items 2 to 17.

The inventors have surprisingly found that the use of a rope of fibrous plant material, especially straw, overcomes the drawbacks mentioned above. More precisely, fibrous plant material, such as straw, shows a spreading effect during stranding, resulting in cavities in a strand or rope produced, whereby suitably high inflammability and, at the same time, sufficiently long burning time can be obtained. Accordingly, rapid and efficient inflammation and good combustibility are achieved.

The invention does not only allow use of an abundantly available plant material, which is a renewable energy source, for heat production, but also allows avoiding costs and waste of energy for producing the combustible material and for transporting to consumers or operators of heating systems. The combustible material of the invention can be produced on site, such as on a farm field where the fibrous plant material is harvested or produced, the rope can be wound up and be transported to nearby consumers. Transport over long distances is generally not necessary, since suitable fibrous plant material is abundantly available in many climate zones. Thus, the invention provides the use of an abundantly available plant material for heat production in the region where the plant material has grown. Consequently, the invention contributes for multiple reasons to environmentally friendly heat production by heating systems.

DETAILED DESCRIPTION OF THE INVENTION

Figure 1A:
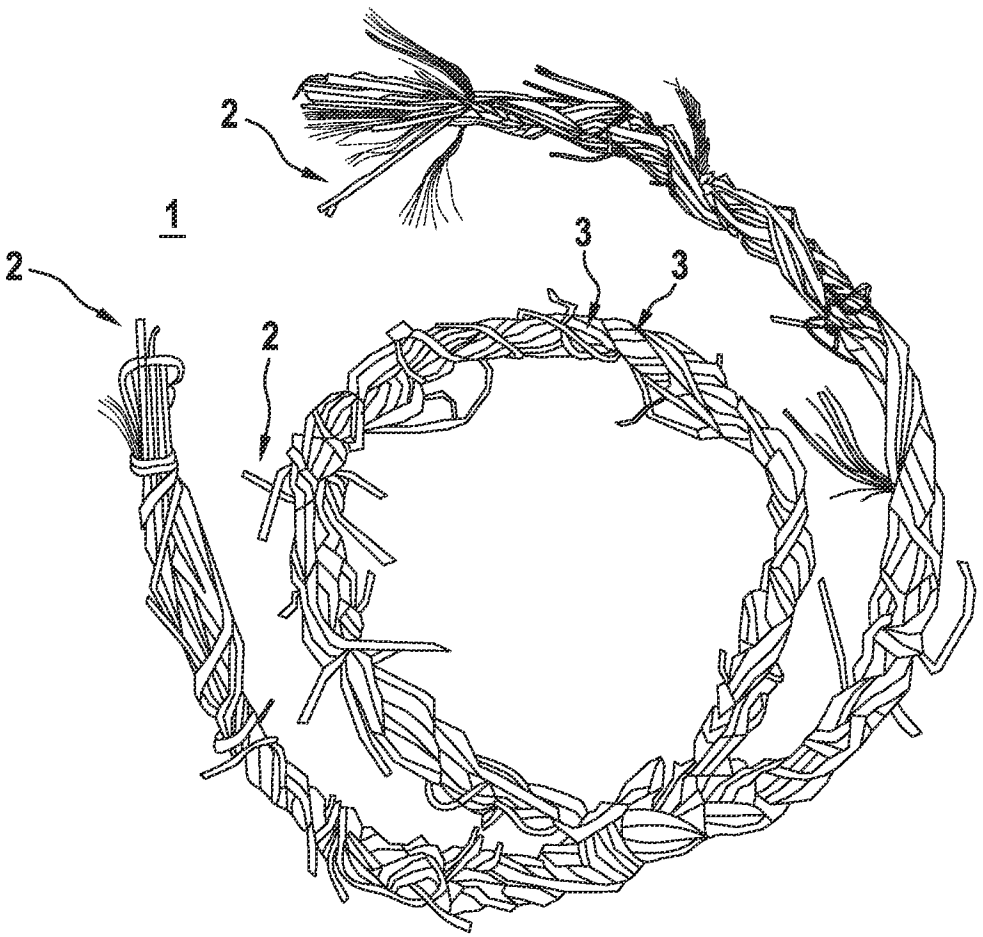
FIG. 1A is a photograph of a rope of straw.

In the method and use of the present invention, a rope is used as combustible material in or for a heating system. The rope comprises or consists of, or is made of, fibrous plant material. The inventor has found that ropes made of fibrous plant material have advantageous properties for use as combustible material in a heating system, such as a good balance between being sufficiently compact for having good caloric value (content) per volume and sufficiently long burning time. Moreover, ropes of fibrous plant material have a sufficiently high surface for having good inflammability. Moreover, ropes are sufficiently stiff for allowing controlled feeding into the combustion chamber of a heating system, e.g. by mechanical or automatic means.

The fibrous plant material usable for the invention may be entire fibrous plants or fibrous parts of plants. Fibrous plant material is common in nature, whereby plants of many different plant species, or parts thereof, are possible sources of the fibrous plant material of the invention. Both monocotyledonous and dicotyledonous plants are possible sources of the fibrous plant material, whereby the former are preferred, Poaceae plants are more preferred and Pooideae plants are even more preferred. Among these, hay and straw of Poaceae plants are more preferred and hay and straw of Pooideae plants are even more preferred, and straw, notably of Pooideae plants, is the most preferred fibrous plant material In a preferred embodiment, the fibrous plant material comprises or consists of blades of plants, such as blades of monocotyledonous plants, preferably blades of Poaceae or Pooideae plants, preferably hay or straw blades. Among these, hay and straw are preferred and straw is the most preferred fibrous plant material. Herein, a "blade" is considered the stem of a Poaceae or Pooideae plant. Other examples of the fibrous plant material are cotton, coconut fiber, bagasse, and branches of trees or bushes.

Individual elements of the fibrous plant material are referred to herein as "elongated elements" or "fibers". Since the plant material used for the invention is fibrous, the individual elements of the fibrous plant material are elongated. "Elongated" herein means that the elements are at least 10-fold, preferably at least 20-fold, longer in one dimension than in both other dimensions. For example, a straw blade of essentially round cross-section may have a length of about 4 mm in the two dimensions of the cross-section and a length of about 40 cm in the longitudinal dimension. Herein, the "longitudinal dimension" of an elongated element is that of the longest extension of the elongated element, while the other two dimensions at right angles to the longitudinal dimension may be referred to as "transverse dimensions" or "short dimensions".

The transverse dimensions of the elongated elements may be the same or different and may be from 0.1 to 40 mm, preferably from 0.1 to 20 mm, preferably from 0.2 to 10 mm, more preferably from 0.5 to 6 mm and most preferably from 1.0 to 4 mm. The longitudinal dimension of the elongated element is not particularly limited, but may be from 1 cm to 300 cm, preferably from 3 cm to 200 cm, more preferably from 8 cm to 100 cm, and most preferably from 15 cm to 80 cm.

In preferred embodiments, the transverse dimensions of the elongated elements may be the same or different and may be from 0.2 to 10 mm and the longitudinal dimension may be from 1 cm to 300 cm; or the transverse dimensions of the elongated elements may be the same or different and may be from 0.2 to 10 mm and the longitudinal dimension may be from 3 cm to 200 cm; or the transverse dimensions of the elongated elements may be the same or different and may be from 0.2 to 10 mm and the longitudinal dimension may be from 8 cm to 100 cm; or the transverse dimensions of the elongated elements may be the same or different and may be from 0.2 to 10 mm and the longitudinal dimension may be from 15 cm to 80 cm.

In other preferred embodiments, the transverse dimensions of the elongated elements may be the same or different and may be from 1.0 to 4 mm and the longitudinal dimension may be from 1 cm to 300 cm; or the transverse dimensions of the elongated elements may be the same or different and may be from 1.0 to 4 mm and the longitudinal dimension may be from 3 cm to 200 cm; or the transverse dimensions of the elongated elements may be the same or different and may be from 1.0 to 4 mm and the longitudinal dimension may be from 8 cm to 100 cm; or the transverse dimensions of the elongated elements may be the same or different and may be from 1.0 to 4 mm and the longitudinal dimension is from 15 cm to 80 cm.

The rope of the invention is or can be produced from the fibrous plant material. The rope may comprise one or more strands. The number of strands of the rope is not particularly limited, and the number may be one, two, three, four or higher. Thus, the rope can be single-stranded or multi-stranded. Embodiments wherein the rope comprises or consists of one, two or three strands are preferred, and ropes comprising or consisting of one or two strands are more preferred. Multi-stranded ropes are also referred to herein as "twisted ropes", since multiple (i.e. two or more) strands are generally twisted around each other to form the multi-stranded ropes. Thus, the rope may be a two-stranded or three-stranded twisted rope. In some embodiments, the rope is a single-stranded rope or a two-stranded rope.

Figure 1B:
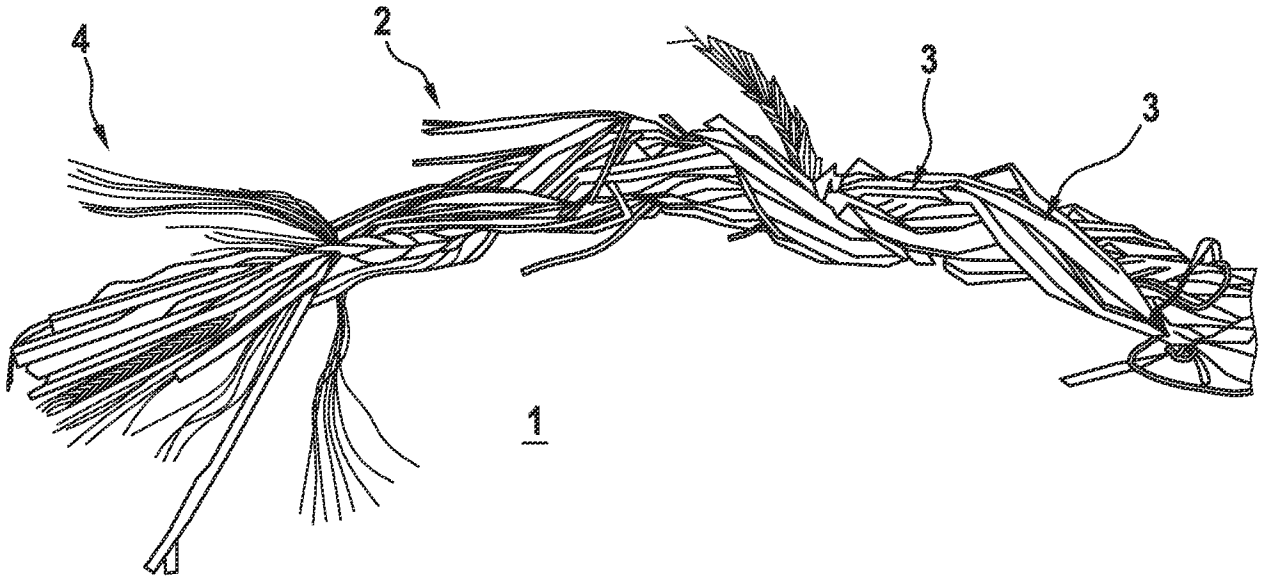
FIG. 1B is a photograph of one end of the straw rope of FIG. 1A.

A multi-stranded rope can be made by twisting multiple strands together to form the multi-stranded rope. The rope may comprises or consist of at least two strands made of the fibrous plant material, said strands being twisted to form said rope. An example of a two-stranded rope is shown in FIG. 1, wherein numeral 1 identifies a rope, numerals 3 identify strands of the two-stranded rope, and numeral 2 identifies straw blades as examples of elongated elements from which the strands are made. Numeral 4 is a string that secures the rope. One strand of the two-stranded rope shown could be used as a single-stranded rope.

A strand of a multi-stranded rope or the single-stranded rope can be produced from the fibrous plant material. The strand or rope generally has a much higher length than the elongated elements of the fibrous plant material. Techniques for producing long, even endless, strands from elongated elements of fibrous plant material have been known for centuries and even since ancient times. For example, threads or yarns for sewing and weaving have been produced for ages by spinning, which is part of the general knowledge of the skilled person. Spinning is defined by Wikipedia as the twisting together of drawn-out strands of fibers to form yarn. While yarn is generally thinner than the strands preferred for the present invention, the technique used to form the strands of the invention from the elongated elements is analogous to the production of yarn from fibers of e.g. cotton or wool. The term "stranding" is used herein analogously to "spinning" for indicating that the strands produced for the invention are generally thicker than yarn. Stranding has also been known for very long times, and, for example, straw ropes have been known for centuries. Therefore, the production of the strands or single-stranded ropes of the invention is part of the general knowledge of the skilled person. Also, spinning devices, especially spinning wheels, are commonly known. Devices for spinning or stranding straw have also been known for a long time. For example, DE77644 from the year 1894 relates to a spinning machine for straw or equivalent materials. DE 459 288 discloses a spinning machine for producing strong ropes of straw or dry herbs. Where the strand or rope is made of straw, the stranding leaves the lignin layer of the straw blades largely intact, as opposed to straw in straw pellets. Therefore, the adsorptive capacity for water of the straw does not increase or increases only to a minor extent by the formation of the rope.

In the production of the strands or single-stranded rope of the invention, a large number of elongated elements are generally used. In one embodiment, the strands are made from at least 2, preferably at least 20, preferably at least 100, more preferably at least 1000, even more preferably at least 10 000, and most preferably at least 100 000 elongated elements to make a strand by spinning or stranding. As mentioned above, the elongated elements may be those mentioned above, such as straw blades. At any given position of a strand, there are generally multiple elongated elements or fibers when viewed in orthogonal direction to the longitudinal dimension of the strand. There may be at least 5, preferably at least 10, more preferably at least 20, even more preferably at least 50 and even more preferred at least 200 fibers or elongated elements in parallel in a strand.

The strand or single-stranded rope may be made by orienting multiple (at least two) elongated elements of the fibrous plant material essentially in parallel so as to form a combination of partially overlapping elongated elements essentially oriented in parallel, optionally securing the elongated strands together at a desired position of the combination, twisting the elongated elements (e.g. starting from the secured position) while continuously feeding further elongated elements into the twisting combination to form a strand or one-stranded rope. Where a multi-stranded rope is to be produced, multiple strands may be twisted to the multi-stranded rope.

The strand according to the invention may have a diameter of, generally, from 1 to 50 cm, preferably of from 2 to 30 cm, more preferably of from 3 to 15 cm. In certain instances, the strand may also have a diameter of more than 50 cm. The diameter of the strand does not need to be constant, but may vary along the length of the strand. The preferred diameter of the strands depends on the material of the elongated elements or the blades, and/or amount of strands used for the rope.

As mentioned above, the strand produced as described above represents a single-stranded rope and may directly be used as a combustible material in the invention. Alternatively, a multi-stranded rope may be produced from multiple strands, e.g. by twisting the multiple strands together.

The rope according to the invention may have a diameter of from 2 to 100 cm, preferably of from 3 to 80 cm, more preferably of from 4 to 50 cm. The rope may have a length of at least 1 m, preferably at least 3 m, more preferably at least 10 m, and most preferably at least 30 m. The rope or strands of the rope of the invention may be tied together at the ends thereof or at intervals with one or more strings to prevent undesired loosening. The ropes according to the invention can be wound up or coiled to rolls for storage, or may be wound around cylindrical or pyramid-like cones.

The tear strength of the rope used in the invention is not particularly limited provided its strength is sufficient to allow winding up and transport to and into a heating system. A tear strength of the rope is preferably at least 10 kg.

In order to be combustible with little emission of smoke or dust upon combustion, the rope should be sufficiently dry. The preferred maximum water content of various plant materials for combustion is generally known to the skilled person. The preferred fibrous plant material is straw obtained as a by-product upon harvesting cereals on a farm field. When cereals are harvested, they should have a known maximum water content so that no energy-consuming drying is necessary after harvesting. It is an advantage of the invention that if the cereals are sufficiently dry, the straw obtained as a by-product is generally also sufficiently dry for production of a rope that can be used as the combustible material in the invention.

Production of the rope may be done on site where the plant material is harvested, such as on a farm field. The rope may, for example, be formed by a device that may be attached to a harvester or combine harvester. Alternatively, the plant material may be transported to a different site for production of the rope. The rope produced may be wound up to form a roll for allowing easy handling and storing of large amounts of the rope. The rope may then be transported to a place where a heating system is to be provided with the rope as combustible material.

The rope of the invention can be used e.g. as a firelighter or to achieve a desired, advantageous (i.e. high) gross calorific value such as for heating. If used as a firelighter, a loose twisting of the rope is recommended. For this use, the strands of a multi-stranded rope may be twisted such that the length of the rope has more than 67% of the length of the strands before twisting of the strand to form the rope. In contrast, if used for achieving a high calorific value such as when used as a combustible material for a heating system, a tight twisting of the rope is recommended. For this purpose, it is preferred that the strands are twisted such that the length of a multi-stranded rope has less than 67% of the length of the strands before twisting of the strands to form the rope.

A central core can be introduced inside the rope and/or the strand(s), which is preferably soaked with paraffin and/or wax. This results in a further increase of the gross calorific value.

In the method of operating a heating system, a combustible material is fed to a combustion chamber of a heating system, wherein said combustible material is the rope of fibrous plant material described above. The heating system may e.g. be a heater, a furnace and/or a central heating system. The heating system can be e.g. in or for a residential building, office building, industrial plant, public or private swimming pool, or other facility. Suitable heaters or heating systems are known in the art or can be modified to be fed with ropes.

The rope may be fed by hand into a combustion chamber of a heating system. Preferably, however, the rope is fed into a combustion chamber of a heating system by a feeding device, such as that shown in FIGS. 2A and 2B. The feeding device may be controlled such as to feed the rope into the combustion chamber at a desired rate for achieving a desired burning rate and/or heat generation.

Figure 2A:
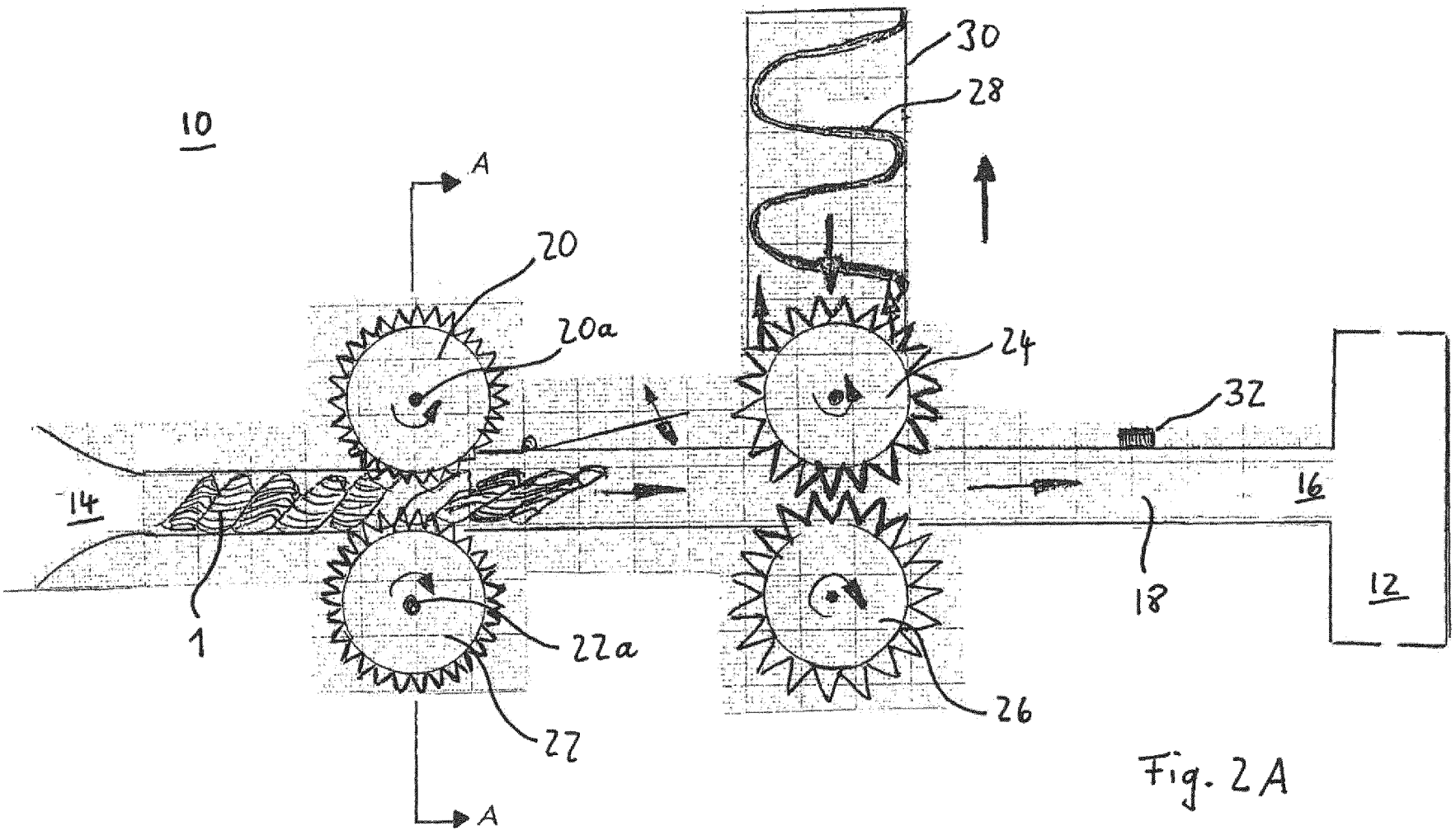
FIG. 2A schematically illustrates a feeding device for ropes to a combustion chamber of a heating system.
Figure 2B:
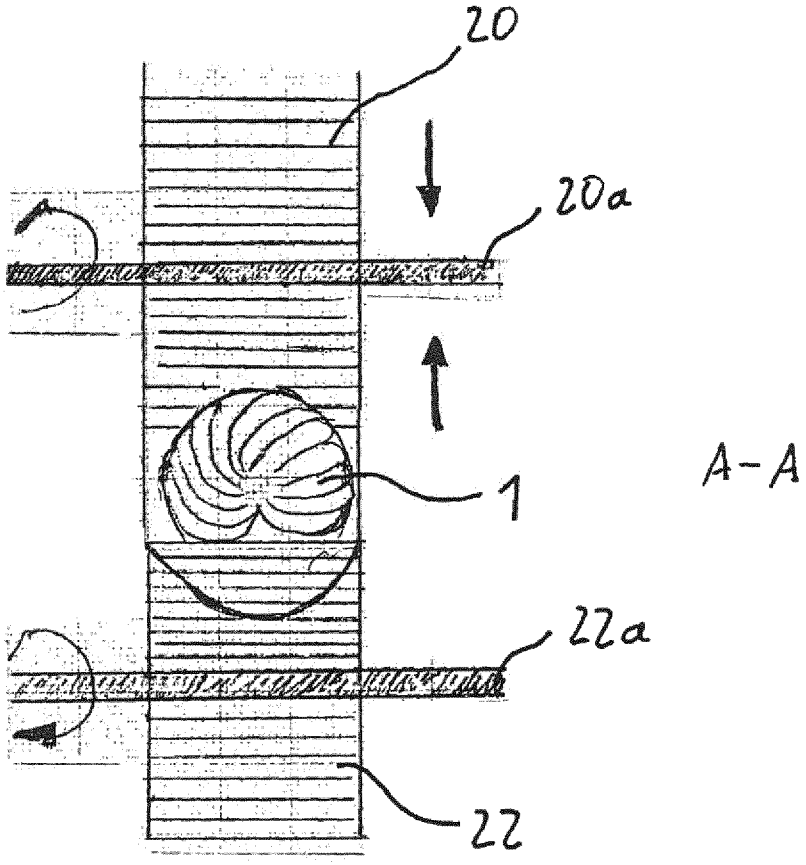
FIG. 2B represents the A-A cross of the feeding device at the position indicated in FIG. 2A.

FIG. 2A schematically illustrates a fuel feeding device 10 which functions to transport a rope 1 into a combustion chamber 12. FIG. 2B represents a cross-section at line A-A of FIG. 2A. The fuel feeding device 10 has an inlet 14, an outlet 16, and a channel 18 between inlet 14 and outlet 16.

A pair of conveyer rolls 20 and 22 are provided that rotate in opposite directions around axes 20*a* and 22*a*, respectively, driven by an electric motor. Thereby, the rolls move the rope along the channel 18 towards combustion chamber 12. Rolls 20 and 22 are spaced apart to allow rope 1 to pass between the oppositely rotating rolls. The rolls may have a rough or ribbed surface. A second pair of conveyer rolls 24 and 26 may be provided for conveying the rope towards combustion chamber 12.

Rolls 24 and 26 provide a mechanism to prevent that fire of burning rope can move leftwards beyond the position defined by roles 24 and 26. Lower roll 26 may be arranged at a fix position. Upper roll 24 may be movable in right angle direction to the direction of the moving rope, i.e. vertically. Upper roll 24 may be pressed downward by pressure spring 28 located in housing 30 towards roll 26. When rolls 24 and 26 abut or nearly abut each other, channel 18 can be blocked and fire cannot move in the direction of incoming rope. If the rope is to be conveyed to the combustion chamber, upper roll 24 is driven by a motor upwards against the force of pressure spring 28, thereby allowing the rope to pass through the open space between rolls 24 and 26. A temperature measuring device 32 may be attached to the channel close to the outlet. When the temperature measured exceeds a predetermined level, or in case of a power outage, transport of rope may be stopped and/or the motor driving or maintaining roll 24 upwards is released, whereby spring 28 moves roll 24 downward to close the gap between roll 24 and 26.

An alternative mechanism to prevent that fire propagates leftwards of the position defined by roles 24 and 26, is (instead of roles 24 and 26) a metal plate that is movable in vertical direction in guide grooves, and that obstructs channel 18 when in bottom position. When the rope is to be conveyed to the combustion chamber, the metal plate is moved upwards to unblock channel 18. When the temperature measuring device 32 measures a temperature exceeding a predetermined level or in case of a power outage, the metal plate is moved downwards, or is released and falls down by gravity, to obstruct the channel 18. The metal plate may have a sharp bottom edge so as to cut the rope 1 present in channel 18 when falling or being moved down.

In one embodiment, the feeding rate of the rope on the feeding device is controlled so as to provide a desired heat generation upon burning the rope in the combustion chamber.

The content of German Patent application DE 10 2017 119 897.0 filed on Aug. 30, 2017 is herewith incorporated by reference including description, claims and drawings.

The invention claimed is:

1. A use of a rope as a combustible material for heating in a heating system, said rope comprising or consisting of fibrous plant material, wherein the rope is fed mechanically into a combustion chamber of the heating system by a feeding device, wherein the rope is wound and the rope is fed into the combustion chamber of the heating system while unwinding the rope.

2. The use according to claim 1, wherein said rope comprises at least two strands made of the fibrous plant material, said strands being twisted to form said rope.

3. The use according to claim 2, wherein the strands are twisted to form said rope such that the length of the rope has less than 67% of the length of the strands before twisting of the strands to form the rope.

4. The use according to claim 2, wherein the strands are made from multiple elongated elements of the fibrous plant material by stranding or spinning.

5. The use according to claim 2, wherein each strand has a diameter of from 1 to 20 cm.

6. The use according to claim 1, wherein said rope is a two-stranded or three-stranded rope.

7. The use according to claim 1, wherein said rope is a one-stranded rope made from multiple elongated elements of the fibrous plant material by stranding or spinning.

8. The use according to claim 1, wherein said rope or a strand of said rope is made by orienting at least two elongated elements of the fibrous plant material essentially in parallel so as to form combination of at least partially overlapping elongated elements essentially oriented in parallel, securing the elongated strands together at a desired position of the combination, twisting the elongated elements of the strand starting from the secured position while continuously feeding further elongated elements into the twisting combination to form a strand or one-stranded rope.

9. The use according to claim 1, wherein the rope has a diameter of from 1 to 50 cm.

10. The use according to claim 1, wherein the rope has a length of at least 1 m.

11. The use according to claim 1, wherein the fibrous plant material comprises or consists of blades.

12. The use according to claim 1, wherein the fibrous plant material comprises or consists of blades of monocotyledonous plants.

13. The use according to claim 1, wherein the fibrous plant material comprises or consists of blades of plants of family Poaceae.

14. The use according to claim 1, wherein the fibrous plant material is straw and/or the rope is a straw rope.

15. The use according to claim 1, wherein the heating system is a heater, furnace and/or central heating system of a building or facility.

16. A method of operating a heating system, comprising feeding a combustible material to a combustion chamber of the heating system, said combustible material being a rope of fibrous plant material, wherein the rope is fed mechanically into a combustion chamber of the heating system by a feeding device, wherein the rope is wound and the rope is fed into the combustion chamber of the heating system while unwinding the rope.

17. The method of claim 16, wherein the feeding rate of the rope is controlled so as to provide a desired heat generation upon burning the rope in the combustion chamber.

18. The method of claim 16, wherein said rope comprises at least two strands made of the fibrous plant material, said strands being twisted to form said rope.

* * * * *